US005798677A

United States Patent [19]

Cook

[11] Patent Number: 5,798,677

[45] Date of Patent: Aug. 25, 1998

[54] TUNABLE QUASI-STRIPLINE FILTER AND METHOD THEREFOR

[75] Inventor: Dean Lawrence Cook, Mesa, Ariz.

[73] Assignee: Motorola, Inc., Schaumburg, Ill.

[21] Appl. No.: 755,937

[22] Filed: Nov. 25, 1996

[51] Int. Cl.[6] ..... H01P 1/203

[52] U.S. Cl. ..... 333/204; 333/205; 29/600

[58] Field of Search ..... 333/203, 204, 333/205, 219, 235, 238, 246; 29/600, 846

[56] References Cited

U.S. PATENT DOCUMENTS

| | | | |
|---|---|---|---|
| 4,020,428 | 4/1977 | Friend et al. | 333/203 |
| 4,281,302 | 7/1981 | Stegens | 333/205 X |
| 4,706,050 | 11/1987 | Andrews | 333/205 |
| 4,965,537 | 10/1990 | Kommrusch | 333/207 |
| 5,319,239 | 6/1994 | Shiau et al. | 333/204 |

FOREIGN PATENT DOCUMENTS

| | | | |
|---|---|---|---|
| 0159102 | 6/1990 | Japan | 333/204 |

OTHER PUBLICATIONS

"K–Band T/R–Converter Modules for the Iridium® Satellite Program*", IEEE MTT –S Digest, May 1995–2, David W. Corman, Bill T. Agar, Kenneth V. Buer, Dean L. Cook, Motorola Satellite Communications Division, pp. 1653–1656.

*Primary Examiner*—Seungsook Ham
*Attorney, Agent, or Firm*—Gregory J. Gorrie

[57] ABSTRACT

Quasi-stripline filters (20) are tuned during manufacture to achieve consistent frequency response. A filter structure (20) which accommodates the method (60) is provided. The microstrip filters (30) are fabricated by forming conductive filter patterns (22) upon non-conductive (dielectric) substrates (24), and then bonding those substrates (24) to conductive (metallic) substrates (28). These filters (30) are then entunneled with conductive housings (34) electrically and physically joined to the conductive plates (28). Housings (34) of varying cross-sectional areas (40) are chosen to produce the desired frequency response, thus converting the microstrip filters (30) into quasi-stripline filters (20) with a specific frequency response.

9 Claims, 4 Drawing Sheets

TUNABLE QUASI-STRIPLINE FILTER AND METHOD THEREFOR

FIELD OF THE INVENTION

The present invention pertains to the tuning of quasi-stripline filters. More specifically, the present invention pertains to a method of tuning quasi-stripline filters during their manufacture, as well as specific filter structures to accomplishes this tuning.

BACKGROUND OF THE INVENTION

In a microstrip filter, a conductive filter pattern is formed on a non-conductive dielectric substrate bonded to a conductive plate or substrate or "groundplane." The conductive plate may have other filters or devices mounted to it. Microstrip filters have specific frequency responses determined by the physical and electrical characteristics of their constituent components.

In a stripline filter, by contrast, a conductive filter pattern is formed on a dielectric substrate and "sandwiched" between two groundplanes, usually with greater pattern-to-groundplane spacing than a microstrip filter. Stripline filters have frequency responses different than those of microstrip filters due to the use of different constituent components.

When a microstrip filter is entunneled within a conductive housing, it exhibits a frequency response between those of microstrip and stripline filters. Such a filter is quasi-stripline in nature.

Normally, to produce a quasi-stripline filter, a photolithographic mask for the desired filter pattern is first created. The requisite filter pattern is then photolithographically formed upon a non-conductive dielectric substrate. The patterned non-conductive substrate, or "microstrip filter component," is then bonded to a conductive plate in order to create the microstrip filter. The microstrip filter is then entunneled by a conductive housing. Finally, the frequency response of the completed filter is measured and compared against the desired response.

For stringent filter requirements, the desired filter response may be difficult to achieve given the materials, temperature range, etc. In this case, a new or adjusted photolithographic mask may be made and the entire process repeated until the desired frequency response has been attained.

Once the desired frequency response has been attained, multiple filters may be produced as long as none of the processes or materials vary. For example, another batch of substrate would normally have slightly differing dielectric properties, altering the frequency response of the resulting filter. Consequently, the entire photolithographic process should be repeated for each substrate batch used in order to obtain a filter pattern with the desired frequency response. Variations in other physical parameters of the filter can also cause a shift in frequency response requiring a change in the mask.

The process of creating or altering photolithographic masks is time-consuming and costly. Moreover, it requires highly skilled personnel, thereby exacerbating the costly nature of the process. Also, those filters that fail to meet required specifications are rejected, hence adding to the cost of the process. These factors combine to cause conventional manufacturing processes for quasi-stripline filters to be both costly and inefficient.

Thus what is needed is a filter that posseses a universal tuning method. What is also needed is a tuning method that requires only a single filter pattern, and a single photolithographic mask, regardless of design vagaries and/or differences in substrate dielectric properties. What is also needed is a tuning method that is rapidly executable, performable by lower skill level personnel, and reduces wastage. Furthermore, what is needed is a tuning method that increases efficiency and reduces costs.

BRIEF DESCRIPTION OF THE DRAWINGS

A more complete understanding of the present invention may be derived by referring to the detailed description and claims when considered in connection with the figures, wherein like reference numbers refer to similar items throughout the figures, and:

DETAILED DESCRIPTION OF THE DRAWINGS

Figure 1:
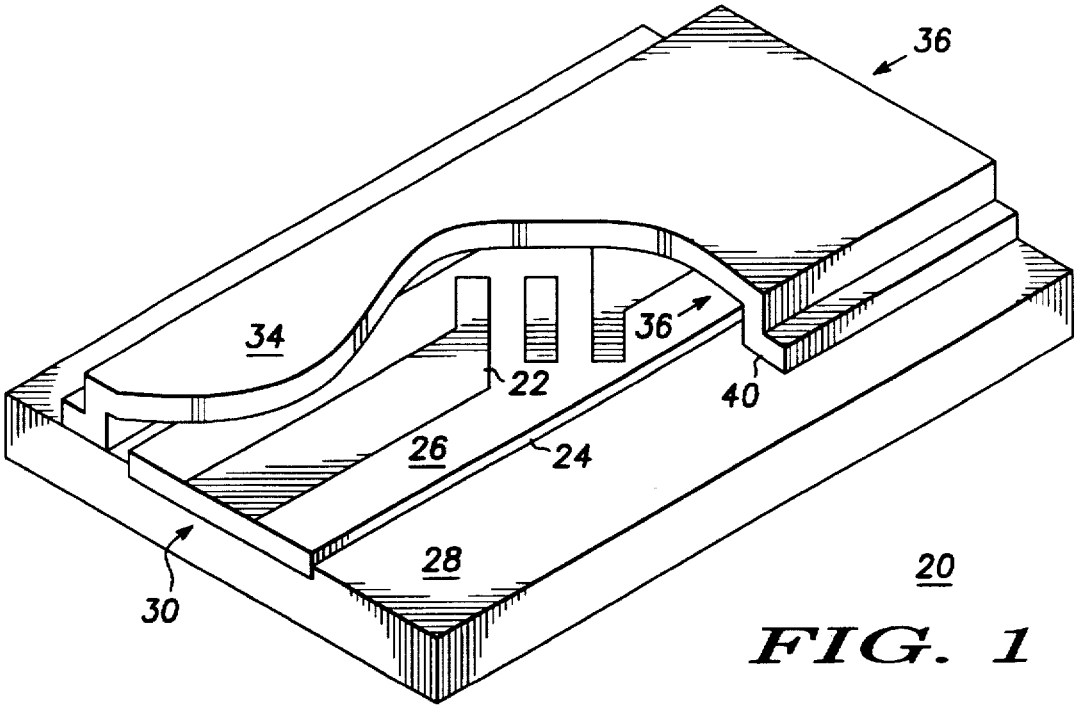
FIG. 1 depicts an anisometric view of an assembled quasi-stripline filter in accordance with a first preferred embodiment of the present invention.

FIG. 1 depicts an anisometric view of an assembled quasi-stripline filter 20 in accordance with a first preferred embodiment of the present invention. In this embodiment, filter 20 is made up of a conductive filter pattern 22 photolithographically formed upon a non-conductive (dielectric) substrate 24 to form a filter component 26. Component 26 is then bonded to a conductive (metallic) substrate 28, becoming a microstrip filter 30.

Conductive plate 28, also called a "groundplane," may be a flat or machined metallic plate or substrate to which the components for the microwave circuit, of which filter component 26 is one, are attached. Conductive plate 28 may also be a non-metallic plate such as plastic, with a conductive coating.

If conductive plate 28 were a flat plate, filter component 26 may be attached to the surface of conductive plate 28, as would be all other components. This allows assembly of a less costly quasi-stripline filter 20.

Conversely, conductive plate 28 may be machined with various protuberances, ridges, channels, depressions, etc., hereinafter referred to collectively as protrusions 32. Protrusions 32 form a basis for locating, registering, or fastening components to conductive plate 28. Exemplarily, component 26 is bonded to conductive plate 28 between protrusions 32.

Microstrip filter 30 is then entunneled in a conductive housing 34 (a "doghouse") which is electrically and physically joined to conductive plate 28. This creates a tunnel 36 around microstrip filter 30. Tunnel 36 causes microstrip filter 30 to become a quasi-stripline filter 20, i.e. a filter whose frequency response departs from those of a purely microstrip filter and approach those of a stripline filter.

Figure 2:
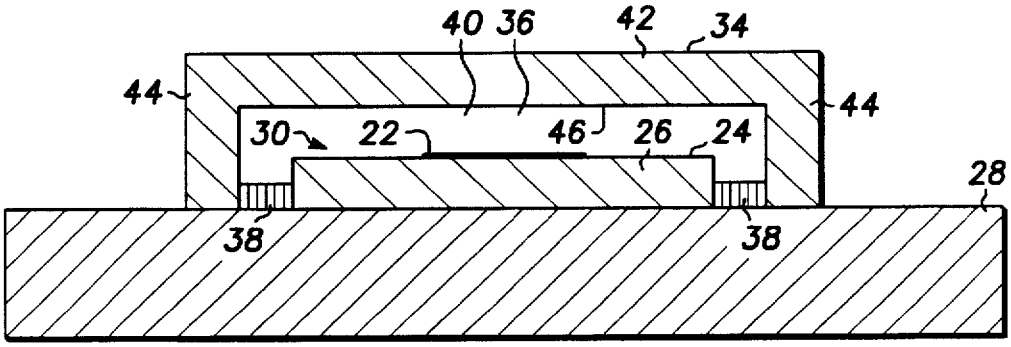
FIG. 2 shows a cross-sectional end view of a tunable quasi-stripline filter having a planar conductive plate and an integrally-formed housing in accordance with a second preferred embodiment of the present invention.

FIG. 2 shows a cross-sectional end view of a tunable quasi-stripline filter 20 having a flat conductive plate 28 and an integrally-formed housing 34 in accordance with a second preferred embodiment of the present invention. In this embodiment, conductive plate 28 is a flat piece of metal, usually aluminum, to which all components are fastened. Spacers 38, which may be part of housing 34, may be used to position housing 34 relative to microstrip filter component 26. Spacers 38 may also be made from a non-conductive material such as a low-loss dielectric. Varying the internal dimensions of housing 34 produces alternative cross-sectional areas 40 and tunes filter 20.

Figure 3:
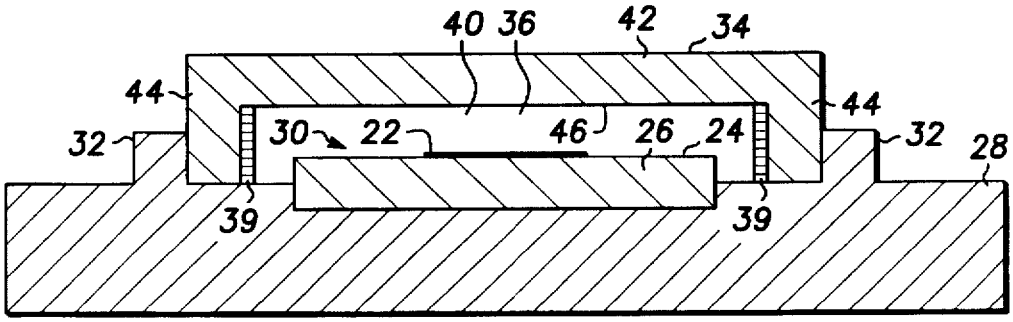
FIG. 3 shows a cross-sectional end view of a tunable quasi-stripline filter having a milled conductive plate and an integrally-formed housing in accordance with the first preferred embodiment of the present invention.

FIG. 3 shows a cross-sectional end view of a tunable quasi-stripline filter 20 having a milled conductive plate 28 and an integrally-formed housing 34 in accordance with the first preferred embodiment of the present invention. In this embodiment, also depicted in FIG. 1, conductive plate 28 is a milled piece of metal with protrusions 32 integrally formed as a part of the milling process. Housing 34 is shown positioned between protrusions 32. Varying the thicknesses of cover 42 and sidewalls 44 varies the internal dimensions of housing 34 and produces alternative cross-sectional areas 40 to tune filter 20.

In an alternative embodiment, conductive shims 39 may be places within housing 34 as shown to vary the width to help achieve a desired frequency response. Additionally, conductive shims may also be placed inbetween housing 34 and the conductive plate 28 to vary the height of the housing thereby changing the cross-sectional area of the housing.

Figure 4:
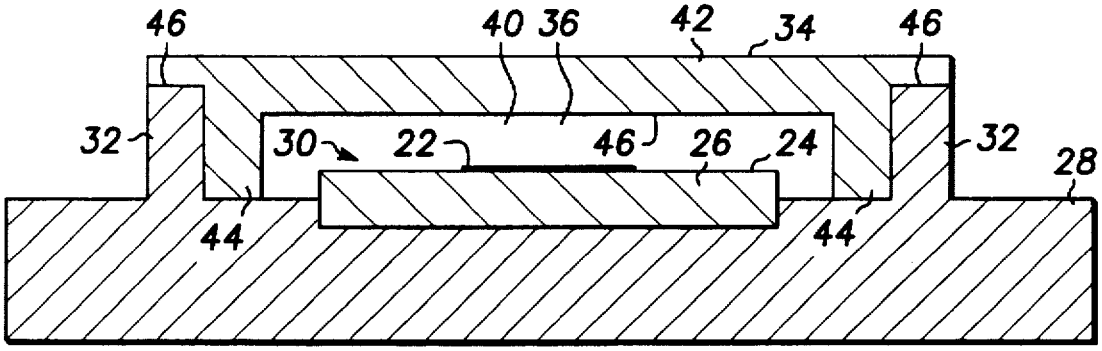
FIG. 4 shows a cross-sectional end view of a tunable quasi-stripline filter having a milled conductive plate and an integrally-formed housing with insertive sidewalls in accordance with a third preferred embodiment of the present invention.

FIG. 4 shows a cross-sectional end view of a tunable quasi-stripline filter 20 having a milled conductive plate 28 and an integrally-formed housing 34 with insertive sidewalls 44 in accordance with a third preferred embodiment of the present invention. As in FIG. 3, this embodiment uses a milled conductive plate 28 with protrusions 32 integrally formed as a part of the milling process. Varying the thicknesses of cover 42 and sidewalls 44 varies the internal dimensions of housing 34 and produces alternative cross-sectional areas 40 to tune filter 20.

Figure 5:
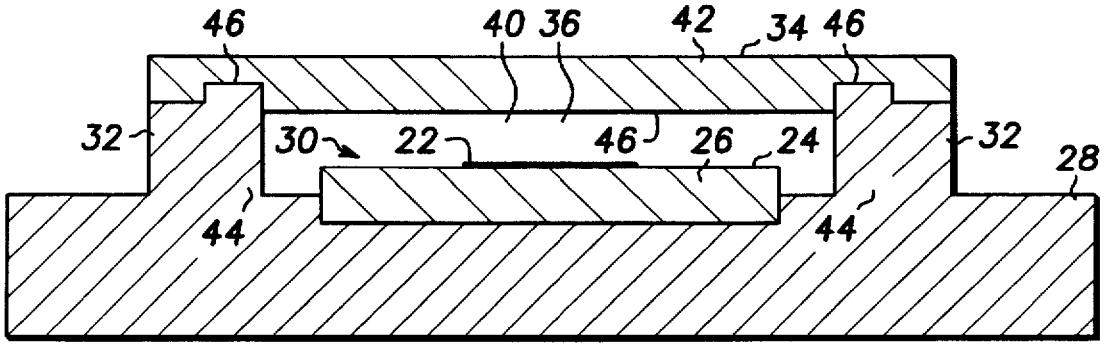
FIG. 5 shows a cross-sectional end view of a tunable quasi-stripline filter having a milled conductive plate with integral sidewalls in accordance with a fourth preferred embodiment of the present invention.

FIG. 5 shows a cross-sectional end view of a tunable quasi-stripline filter 20 having a milled conductive plate with integral sidewalls 44 in accordance with a fourth preferred embodiment of the present invention. In this embodiment, housing 34 is essentially cover 42, with sidewalls 44 being formed by protrusions 32 of conductive plate 28. Varying the thickness of cover 42 produces housings 34 with alternative cross-sectional areas 40 to tune filter 20.

Those skilled in the art may readily envision alternative shapes of housing 34, as well as alternative methods of positioning housing 34 relative to microstrip filter component 26.

The following discussion is based upon FIGS. 1–5.

Tunnel 36 has a rectilinear cross-sectional area 40, the dimensions of which affect the performance of quasi-stripline filter 20. Several techniques for readily accommodating varying cross-sectional areas 40 to achieve a specific frequency response are shown in FIGS. 2–5. Those skilled in the art may readily devise other techniques.

Housing 34 has three components: a first sidewall 44, a cover 42, and a second sidewall 44. These three components form a series of planes comprising an "uneven" inner surface 46, i.e., a "surface" made up of all inside surfaces parallel to and perpendicular to the surface of conductive plate 28. In FIGS. 2–5, this uneven surface 46 comprises "inside" surfaces of housing 34 from first through final contact with any portion of conductive plate 28, and is illustrated with a heavy line for clarity.

The dimensions of the internal surfaces of cover 42 and sidewalls 44 determine the cross-sectional area 40 of tunnel 36, and tune filter 20. If housing 34 is produced by milling or like process, then varying the thickness of cover 42 and/or sidewalls 44 can produce housings 34 with alternative cross-sectional areas 40. Similarly, if housing 34 is to be produced by bending, then varying the overall dimensions of housing 34 can produce housings 34 with alternative cross-sectional areas 40. In the embodiments shown in FIGS. 2–5, the relevant dimensions of housing 34 are the distance between the inside of cover 42 and filter pattern 22, and the distance between sidewalls 44 (assuming sidewalls 44 are equidistant from filter pattern 22).

Figure 6:
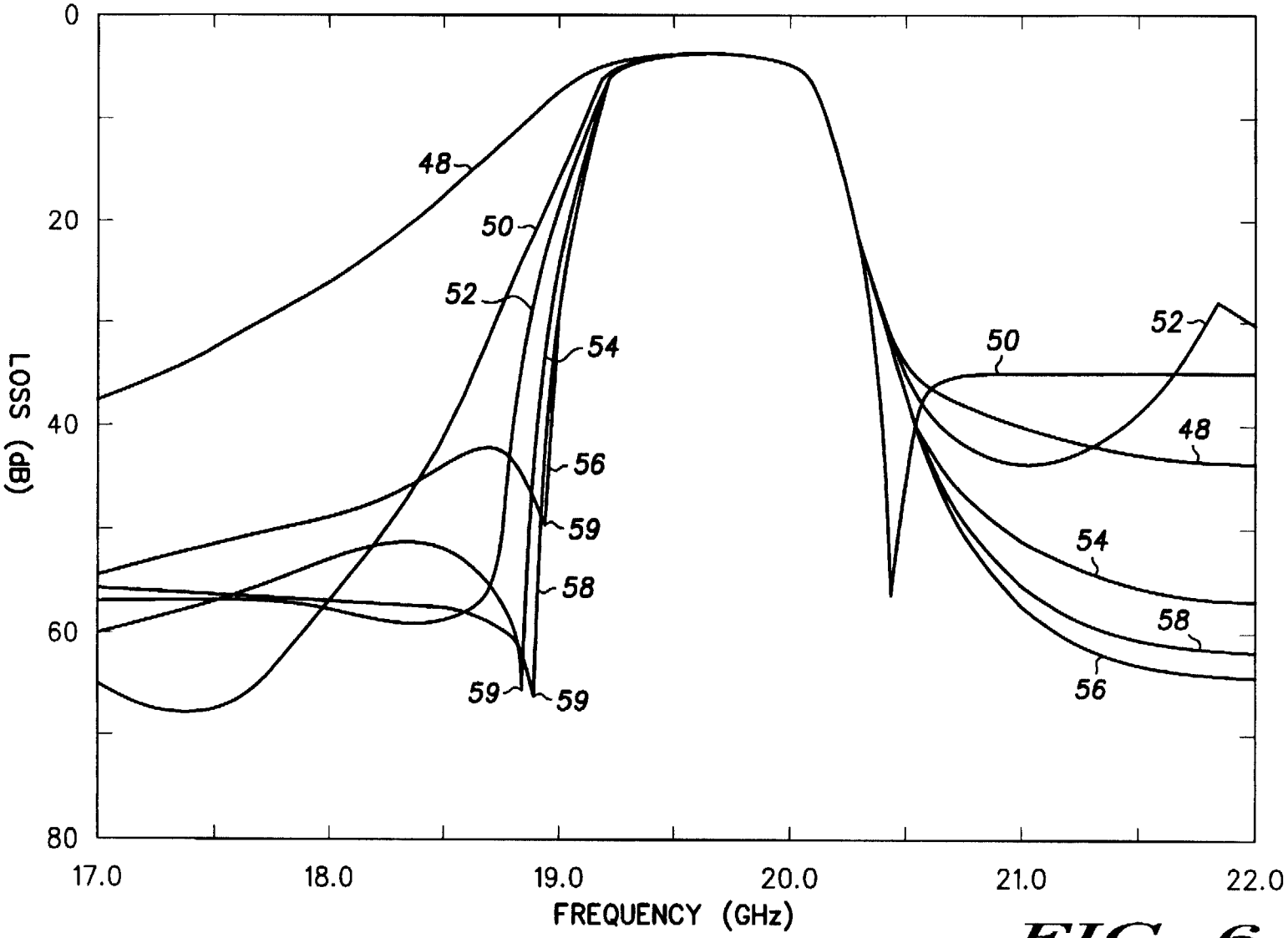
FIG. 6 shows a plurality of bandpass frequency responses of a quasi-stripline filter with different-sized housings.

FIG. 6 shows a plurality of bandpass frequency responses of a quasi-stripline filter with different-sized housings. One purpose of varying the dimensions of housing 34 is to produce a specific frequency response.

In FIG. 6, curve 54 depicts the preferred exemplary frequency response for this embodiment of quasi-stripline filter 20. Curve 54 is produced through the use of a housing 34 with a more optimal cross-sectional area 40.

Curves 48, 50, and 52, on the other hand, depict frequency-responses with bandpasses wider than that desired. Curve 48 is produced by filter 20 operating as a pure microstrip filter, i.e., without a housing 34. Curves 50 and 52 are produced by filter 20 having housings 34 with cross-sectional areas greater than optimal. Similarly, curves 56 and 58 are produced by filter 20 having housings 34 with cross-sectional areas less than optimal, thus producing responses having a bandpass narrower than that desired. The presence of housings 34 produces zeros 59 at rejection frequencies on the skirts of curves 54, 56, and 58.

Figure 7:
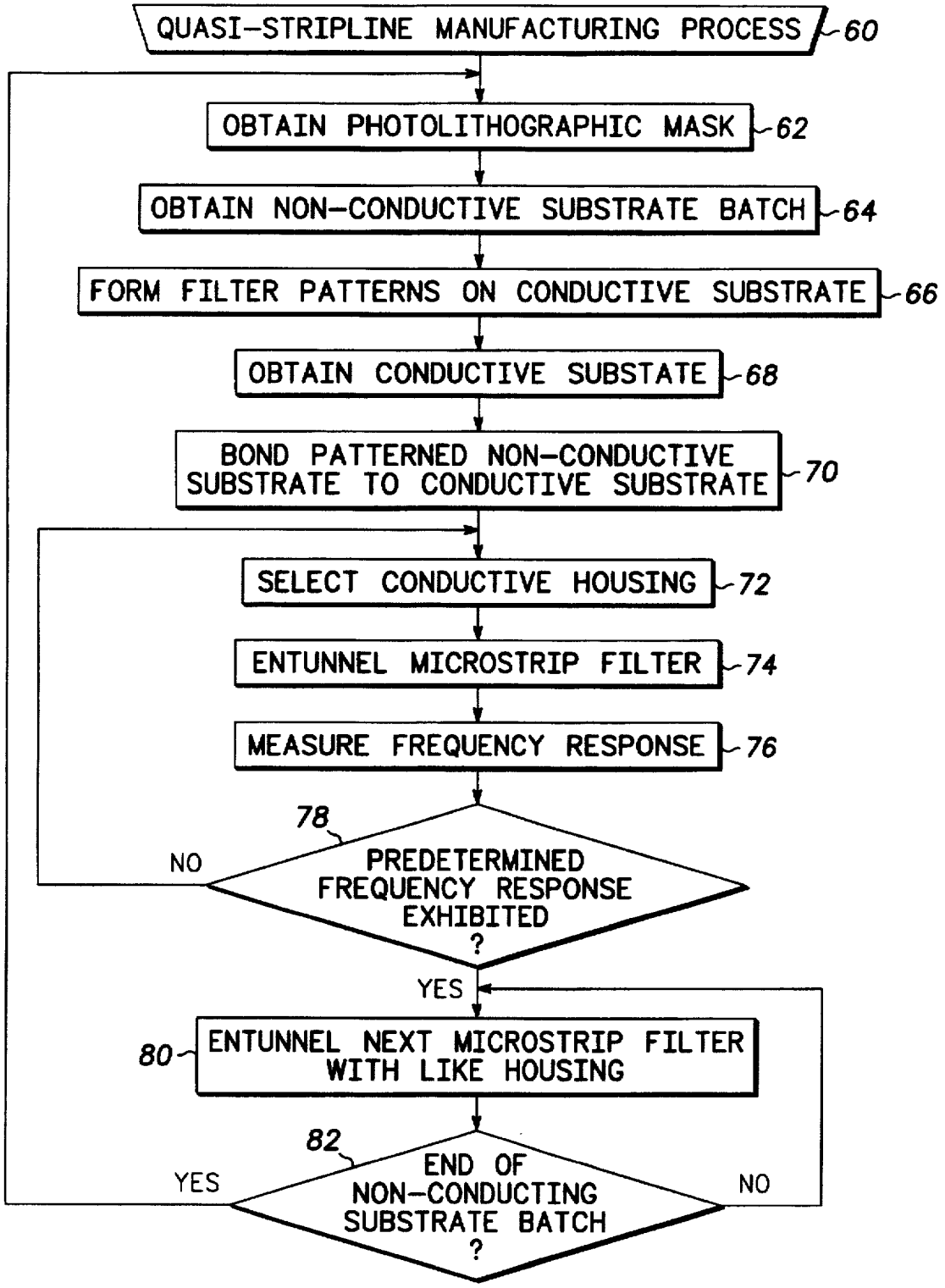
FIG. 7 is a flowchart of a quasi-stripline filter manufacturing process in accordance with a preferred embodiment of the present invention.

FIG. 7 is a flowchart of a quasi-stripline filter manufacturing process 60 in accordance with a preferred embodiment of the present invention.

In a first task 62, a photolithographic mask capable of forming the desired filter pattern 22 (FIG. 1) is obtained or created. Only one such mask is required.

In a next task 64, non-conductive (e.g., dielectric) substrates 24 (FIG. 1) from a single batch are obtained. A batch constitutes those substrates 24 (FIG. 1) having substantially identical dielectric properties. Substrates 24 (FIG. 1) from a different batch may have differing dielectric properties.

Subsequently, in a task 66, the photolithographic mask obtained in task 62 is used to form desired filter pattern 22 (FIG. 1) on each of non-conductive substrates 24 (FIG. 1) obtained in task 64. Of course, several patterns 22 (FIG. 1) may be formed concurrently on several substrates 24 (FIG. 1). At this point, a plurality of essentially identical microstrip filter components 26 (FIG. 1) have been created.

Following the creation of microstrip filter components 26 (FIG. 1), a task 68 is performed in which planar conductive plates 28 (FIG. 1) preferably with perpendicular protrusions 32 (FIG. 1) are obtained. In a task 70, stripline filter components 26 (FIG. 1) are bonded to conductive plates 28 (FIG. 1). At this point, a plurality of microstrip filters 30 (FIG. 1) have been created.

After creation, microstrip filters 30 (FIG. 1) are tuned in tasks 72, 74, 76, and 78. In task 72, one housing 34 (FIG. 1) is selected from among a collection or "kit" of similar housings 34 (FIG. 1), each of which has different dimensions for uneven surface 46 (FIGS. 2 and 3), so as to create a different cross-sectional area 40 (FIG. 3). A selection is often made on a "middle-sized filter" basis so as to allow for a simple binary-search algorithm to find the proper housing 34 (FIG. 1). Those skilled in the art may use a "best guess" selection algorithm based upon experience.

Once a housing 34 (FIG. 1) has been selected, task 74 is performed entunneling one microstrip filter 30 (FIG. 1) with one housing 34 (FIG. 1) to create one quasi-stripline filter 20 (FIG. 1) with a tunnel 36 (FIG. 1) of a specific cross-sectional area 40 (FIG. 3). The frequency response of that filter 20 (FIG. 1) are then measured in task 76 using conventional techniques. In the entunnelment of microstrip filter 30 (FIG. 1) with housing 34 (FIG. 1), conductive housing 34 (FIG. 1) is electrically and physically joined to conductive plate 28 (FIG. 1), e.g. by soldering.

Next, in query task 78 the measurement results are compared to the desired frequency response. If frequency responses do not match, then tasks 72, 74, 76, and 78 are repeated using a different housing 34 (FIG. 1) producing a different cross-sectional area 40 (FIG. 3). This process is repeated until a match is achieved.

Once task 78 has detected a match, then in a task 80 another microstrip filter 30 (FIG. 1) is entunneled with a housing 34 (FIG. 1) of substantially identical dimensions to those of the housing discovered during the last iteration of tasks 72, 74, and 76, so as to produce a substantially identical cross-sectional area 40 (FIG. 3) and substantially identical frequency response, for non-conductive substrates 24 with substantially identical dielectric properties.

After task 80, a query task 82 determines whether a quasi-stripline filter 20 (FIG. 1) produced in task 80 represents the final filter 20 (FIG. 1) of a given batch of non-conductive substrate 24 (FIG. 1). So long as filters 20 (FIG. 1) are produced using the same batch of non-conductive substrate 24 (FIG. 1), tasks 80 and 82 repeat with substantially identical housings 34 (FIG. 1). When a given batch of non-conductive substrate 24 (FIG. 1) has been exhausted, but more filters 20 (FIG. 1) are to be produced, then another batch of non-conductive substrate 24 (FIG. 1) is selected and the process begins again with task 64. In spite of using different non-conductive substrate batches, filter patterns 22 (FIG. 1) will be substantially identical and hence there is no need to alter or re-create the photolithographic mask.

In summary, the present invention improves the manufacture of quasi-stripline filters. All conductive filter patterns 22 are substantially identical for a given batch, and from batch to batch the frequency response may be adjusted using housings 34 of varying sizes. Once the design is complete, the number of photolithographic masks required to produce a given number of filters is reduced from many to one. Selection task 72, entunneling task 74, measurement task 76, and query task 78 should only require an individual skilled in soldering and reading test equipment. The altering or re-creating of photolithographic masks from task 62 (as typically done) may only require an individual of much greater skill. Hence, the tuning of filters has been reduced in skill level required from that of engineer to technician because all of patterns 22 are essentially identical. Components 26 need not be discarded, and the number of unusable filter components 26 constructed is reduced from many to few. Tuning filters 20 by trying different housings 34 is inherently faster than tuning by trying different photolithographic masks and fabricating different filter components 26. Thus, the time required to produce a given number of filters is greatly reduced. Through these reductions, the efficiency of the tuning process is increased at the same time its cost is decreased.

Although the preferred embodiments of the invention have been illustrated and described in detail, it will be readily apparent to those skilled in the art that various modifications may be made therein without departing from the spirit of the invention or from the scope of the appended claims. For example, the process need not adhere to the exact sequence of tasks shown in FIG. 5, multiple batches may be processed simultaneously, multiple filters may be entunneled simultaneously, and the tuning process may be repeated at any time, not necessarily at the end of a batch.

What is claimed is:

1. A method for manufacturing quasi-stripline filters comprising the steps of:

a) selecting a first non-conductive substrate from a first batch of non-conducting substrates and a second non-conductive substrate from a second batch of non-conducting substrates;

b) fabricating a first microstrip filter utilizing said first non-conductive substrate and a second microstrip filter utilizing said second non-conductive substrate;

c) entunneling said first microstrip filter in a first conductive housing of a first predetermined cross-sectional area, said first microstrip filter having a predetermined frequency response;

d) entunneling said second microstrip filter in a second conductive housing of a second cross-sectional area, said second cross-sectional area being dimensioned so that said second microstrip filter has substantially said predetermined frequency response; and e) varying said second cross-sectional area to achieve said predetermined frequency response whereby said quasi-stripline filters fabricated from said first and second batches of substrates have substantially a consistent frequency response.

2. A method for manufacturing quasi-stripline filters comprising the steps of:

a) selecting a first non-conductive substrate from a first batch of non-conducting substrates and a second non-conductive substrate from a second batch of non-conducting substrates;

b) fabricating a first microstrip filter utilizing said first non-conductive substrate and a second microstrip filter utilizing said second non-conductive substrate;

c) entunneling said first microstrip filter in a first conductive housing of a first predetermined cross-sectional area, said first microstrip filter having a predetermined frequency response; and d) entunneling said second microstrip filter in a second conductive housing of a second cross-sectional area, said second cross-sectional area being dimensioned so that said second microstrip filter has substantially said predetermined frequency response, wherein said first and second non-conductive substrates are bonded respectively to first and second conductive plates, and wherein said first predetermined cross-sectional area is determined by a width and height associated with said first conductive housing, and wherein said method further comprises the step of varying said width of said first conductive housing by placing conductive shims within said first conductive housing to achieve substantially said predetermined frequency response with a varied width dimension, and wherein said entunneling step d) includes the step of entunneling said second microstrip filter in said second conductive housing having said second cross-sectional area, said second cross-sectional area having said varied width dimension whereby said quasi-stripline filters fabricated from said first and second batches of substrates have substantially a consistent frequency response.

3. A method for manufacturing quasi-stripline filters comprising the steps of:

a) selecting a first non-conductive substrate from a first batch of non-conducting substrates and a second non-conductive substrate from a second batch of non-conducting substrates;

b) fabricating a first microstrip filter utilizing said first non-conductive substrate and a second microstrip filter utilizing said second non-conductive substrate;

c) entunneling said first microstrip filter in a first conductive housing of a first predetermined cross-sectional area, said first microstrip filter having a predetermined frequency response; and d) entunneling said second microstrip filter in a second conductive housing of a second cross-sectional area, said second cross-sectional area being dimensioned so that said second microstrip filter has substantially said predetermined frequency response, wherein said first and second non-conductive substrates are bonded respectively to first and second conductive plates, wherein said first predetermined cross-sectional area is determined by a width and height associated with said first conductive housing, and wherein said method further comprises the step of varying said height of said first conductive housing by placing conductive shims in-between said first conductive housing and said first conductive plate to achieve substantially said predetermined frequency response with a varied height dimension, and wherein said entunneling step d) includes the step of entunneling said second microstrip filter in said second conductive housing having said second cross-sectional area, said second cross-sectional area having said varied height dimension whereby said quasi-stripline filters fabricated from said first and second batches of substrates have substantially a consistent frequency response.

4. A method as claimed in claim 2 wherein said entunneling step d) additionally comprises the step of determining said second cross-sectional area and said predetermined frequency response.

5. A method as claimed in claim 4 wherein said determining step additionally comprises the step of selecting said second conductive housing from a plurality of housings having varying cross-sectional areas so that said second microstrip filter has substantially said predetermined frequency response.

6. A method as claimed in claim 2 additionally comprising the steps of:

forming said first conductive plate as a plane having integral protrusions fashioned substantially perpendicular to said plane; and forming said second conductive plate as a plane having integral protrusions fashioned substantially perpendicular to said plane.

7. A method as claimed in claim 2 wherein said entunneling step d) comprises the step of configuring said second conductive housing to have an uneven surface which faces said second conductive plate.

8. A method as claimed in claim 1 additionally comprising the steps of:

forming a first conductive filter pattern upon said first non-conductive substrate; and forming a second conductive filter pattern upon said second non-conductive substrate, said second conductive filter pattern being substantially identical to said first conductive filter pattern.

9. A method as claimed in claim 1 wherein:

said first non-conductive substrate exhibits a first dielectric constant; and said second non-conductive substrate exhibits a second dielectric constant, said second dielectric constant differing from said first dielectric constant.

* * * * *